US008739449B2

(12) United States Patent
Patel

(10) Patent No.: US 8,739,449 B2
(45) Date of Patent: Jun. 3, 2014

(54) HIGH STRENGTH UPPER RECEIVER SYSTEM AND METHOD FOR MODULAR RIFLE

(76) Inventor: Swetal K. Patel, Dallas, GA (US)

( * ) Notice: Subject to any disclaimer, the term of this patent is extended or adjusted under 35 U.S.C. 154(b) by 224 days.

(21) Appl. No.: 13/539,551

(22) Filed: Jul. 2, 2012

(65) Prior Publication Data

US 2014/0000142 A1 Jan. 2, 2014

(51) Int. Cl.
*F41A 21/48* (2006.01)

(52) U.S. Cl.
USPC ..... 42/75.02

(58) Field of Classification Search
USPC ..... 42/75.02, 75.01
See application file for complete search history.

(56) References Cited

U.S. PATENT DOCUMENTS

| | | | | |
|---|---|---|---|---|
| 2,736,117 | A * | 2/1956 | Clarkson et al. | 42/75.02 |
| 2,736,118 | A * | 2/1956 | Clarkson et al. | 42/75.02 |
| 2,736,119 | A * | 2/1956 | Clarkson et al. | 42/75.02 |
| 3,208,178 | A * | 9/1965 | Seiderman | 42/71.01 |
| 3,464,136 | A * | 9/1969 | Wilhelm | 42/75.01 |
| 7,574,823 | B2 * | 8/2009 | Nakayama | 42/75.02 |
| 8,087,194 | B1 * | 1/2012 | Vuksanovich | 42/75.02 |
| 8,161,864 | B1 * | 4/2012 | Vuksanovich | 89/191.01 |
| 8,205,373 | B1 * | 6/2012 | Ubl et al. | 42/71.01 |
| 8,240,074 | B2 * | 8/2012 | Vuksanovich | 42/75.02 |
| 8,307,750 | B2 * | 11/2012 | Vuksanovich et al. | 89/191.01 |
| 8,347,540 | B2 * | 1/2013 | Sirois | 42/75.01 |
| 8,479,429 | B2 * | 7/2013 | Barrett et al. | 42/75.02 |
| 8,490,312 | B2 * | 7/2013 | Barrett et al. | 42/75.02 |
| 8,505,227 | B2 * | 8/2013 | Barrett et al. | 42/75.02 |
| 8,539,708 | B2 * | 9/2013 | Kenney et al. | 42/75.02 |
| 2012/0017483 | A1 * | 1/2012 | Vuksanovich | 42/75.02 |
| 2012/0131834 | A1 * | 5/2012 | Barrett et al. | 42/75.02 |
| 2012/0131835 | A1 * | 5/2012 | Barrett et al. | 42/75.02 |
| 2012/0132068 | A1 * | 5/2012 | Kucynko | 89/191.01 |
| 2012/0137563 | A1 * | 6/2012 | Ubl et al. | 42/75.03 |
| 2012/0167433 | A1 * | 7/2012 | Robbins et al. | 42/75.02 |
| 2012/0216439 | A1 * | 8/2012 | Barrett et al. | 42/75.02 |
| 2012/0297656 | A1 * | 11/2012 | Langevin et al. | 42/16 |
| 2012/0311908 | A1 * | 12/2012 | Kenney et al. | 42/75.02 |

* cited by examiner

*Primary Examiner* — Jonathan C Weber
(74) *Attorney, Agent, or Firm* — Thomas | Horstemeyer, LLP

(57) ABSTRACT

A modular rifle includes an upper receiver assembly and a barrel assembly. The upper receiver, typically fashioned from aluminum, can be strengthened by insertion of a hardened metal liner insert inside the aft portion of the upper receiver. The upper receiver liner insert is secured within the aft portion of the upper receiver assembly by engaging screw threads on the liner insert with receiving threads inside the aft portion of the upper receiver and insertion of anchor pins into the aft portion of the upper receiver. The anchor pins impinge the liner insert such that it is prevented from rotating within the upper receiver. The barrel assembly is attached to the liner insert by engaging screw threads on the liner insert with threads within a barrel nut connector sleeve.

20 Claims, 3 Drawing Sheets

HIGH STRENGTH UPPER RECEIVER SYSTEM AND METHOD FOR MODULAR RIFLE

BACKGROUND OF THE INVENTION

A rifle is a type of weapon that fires rounds. Typically, the rifle includes a trigger, a hammer, and a barrel. The round is positioned in the barrel, and, when the trigger is pulled, the hammer fires the round through the barrel. A modular rifle typically includes a lower receiver assembly, an upper receiver assembly housing the barrel, and a coupling mechanism. The M-16 style rifle is a type of modular rifle system commonly used by military and police forces that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed modular rifle system commonly sold and used in civilian applications.

For most M-16/AR-15 style rifle systems, the upper receiver is fashioned out of forged lightweight aluminum on account of its machinability and corrosion resistance. While machining the upper receiver from a solid billet of aluminum may offer added strength over forging of the receiver, the aluminum material of the upper receiver is nevertheless subject to degradation and deformation to the high gas temperatures and operation of the bolt carrier system inside the upper receiver. The bolt carrier is typically fashioned out of hardened steel or another material with similarly higher heat and wear tolerances than aluminum. Friction created by repeated operation of a steel bolt carrier system within an aluminum upper receiver usually causes material wear and shortens the life cycle of the aluminum upper receiver and rifle system.

Providing a system and method for allowing the internal upper receiver assembly to be strengthened with a hardened steel or other high-strength-material liner inside which the bolt carrier system operates provides for a strengthened upper receiver assembly, such that the upper receiver and barrel provide a continuous chamber consisting of high-heat-tolerant and wear resistant material in which the bolt carrier system operates. This leads to increased reliability and longevity of the upper receiver and the life cycle of the rifle system.

SUMMARY

In some embodiments, among others, this new system and method would allow for a strengthened upper receiver assembly for M-16/AR-15 style modular rifle systems. In order to better accommodate the high temperature operating conditions and high-speed action of a steel bolt carrier system, a steel or other hardened metal liner is inserted into the upper receiver assembly and affixed within the upper receiver assembly. The liner also contains machined threads that protrude from the forward face of the aft portion of the upper receiver and provide an attachment point for the barrel assembly. The barrel assembly is then inserted into the fore end of the tube, and a barrel nut connector sleeve is screwed onto the tube threads protruding from the upper receiver assembly. The barrel nut connector sleeve is then tightened to affix the barrel assembly to the upper receiver and provide a continuous, hardened metal conduit in which the bolt carrier system operates.

In some embodiments, among others, to secure the liner inside the upper receiver assembly and keep the liner from rotating within the upper receiver assembly during firing of the rifle, screws or pins are inserted into a flange on each side of the upper receiver assembly adjacent to the opening on the forward face of the upper receiver. The screws or pins impinge the liner on both sides of the liner through grooves machined in the outside of the liner, thereby preventing rotational movement of the liner and traveling of the liner along the longitudinal axis of the barrel and upper receiver assemblies during firing of the rifle. In this manner, the liner remains properly and securely attached within the upper receiver assembly of the rifle system and provides a secure attachment point for the barrel assembly.

In some embodiments, among others, the insertion of the hardened metal liner within the upper receiver assembly allows for a strengthened chamber housing the operation of the bolt carrier system, providing higher reliability and longer operating life of the upper receiver assembly and rifle system.

It should be emphasized that the above-described embodiments of the present invention, particularly, any "preferred" embodiments, are merely possible examples of implementations, merely set forth for a clear understanding of the principles of the invention. Other systems, devices, methods, features, and advantages of the disclosed system and method include variations and modifications apparent or that may become apparent to one of skill in the art upon examination of the following figures and detailed description, without departing substantially from the spirit and principles of the invention. All such modifications and variations are intended to be included within this description and are intended to be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Disclosed below are embodiments of a high-strength upper receiver system and method for a modular rifle system.

Figure 1:
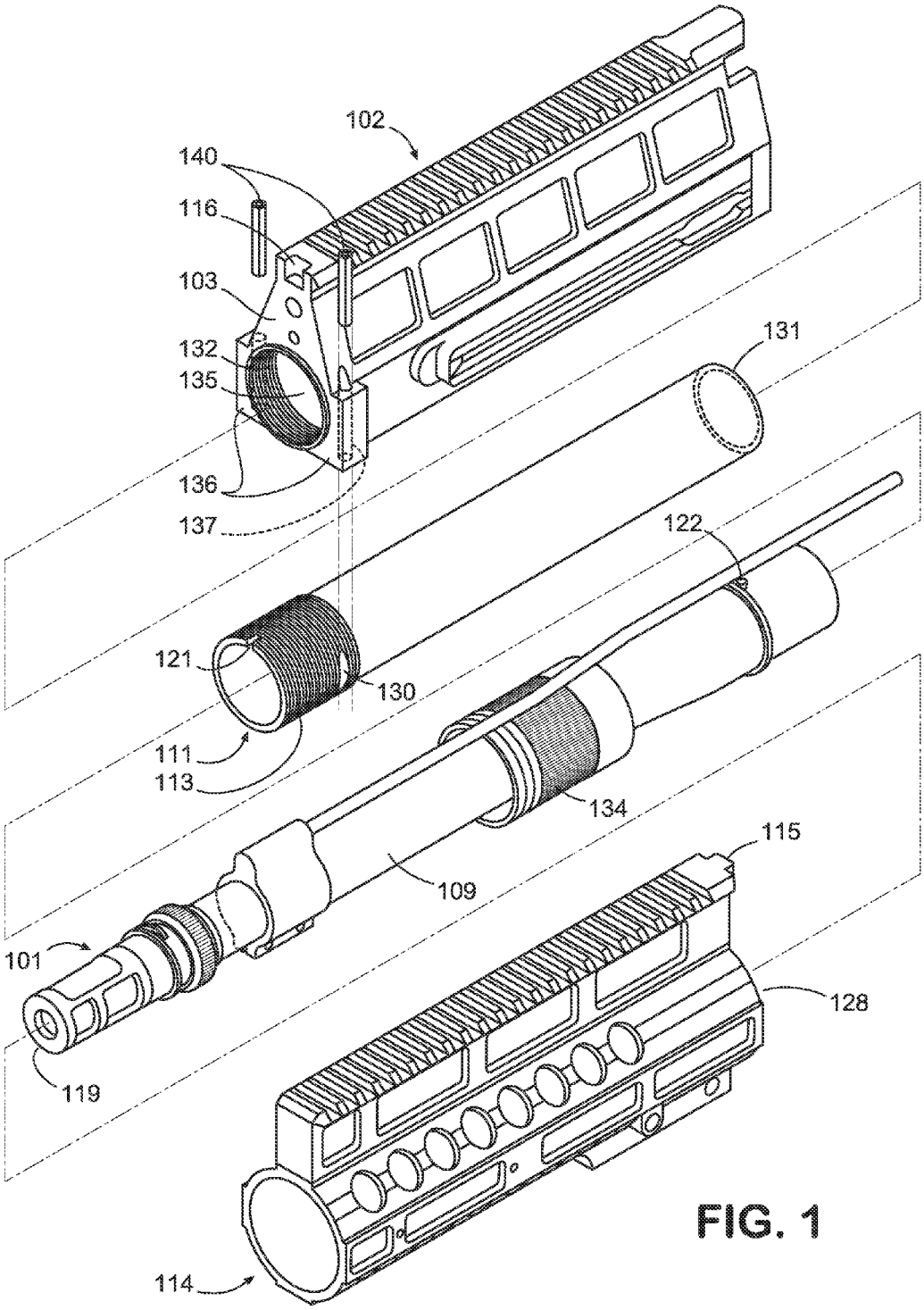
FIG. 1 is an exploded perspective view of two portions of an upper receiver assembly, a barrel assembly, and an upper receiver liner insert in accordance with one exemplary embodiment of the present invention.

FIG. 1 is a perspective view of a fore 114 and aft 102 portions of an upper receiver assembly, a barrel assembly 101, and a liner insert 110 in accordance with one exemplary embodiment of the present invention.

With reference to FIG. 1, aft portion 102 of upper receiver assembly comprises a front face 103 at its fore end 111 containing a circular aperture 135 and two flanges 136 on either side of aperture 135. Aperture 135 contains machined threads 132 along its inner diameter. Flanges 136 each contain a vertical pin insert channel 137. Liner insert 110 may be comprised of stainless steel or another hardened metal composition and contains circumferential machined threads 113 on its fore end 111 and machined indentations 130 on each of two opposing sides of its outside circumference.

With reference to FIG. 1, aft end 131 of liner insert 110 is inserted into aft portion 102 of upper receiver assembly through aperture 135 in front face 103 of aft portion 102 of upper receiver assembly. Liner insert 110 is affixed within aft portion 102 of upper receiver assembly by rotation of machined threads 113 on fore end 111 of liner insert 110 within machined threads 132 in the interior diameter of aperture 135. Liner insert 110 is secured within aft portion 102 of upper receiver assembly by insertion of two anchor pins 140 within each pin insert channel 137 such that the anchor pins 140 impinge indentations 130 on outside circumference of liner insert 110.

Figure 2:
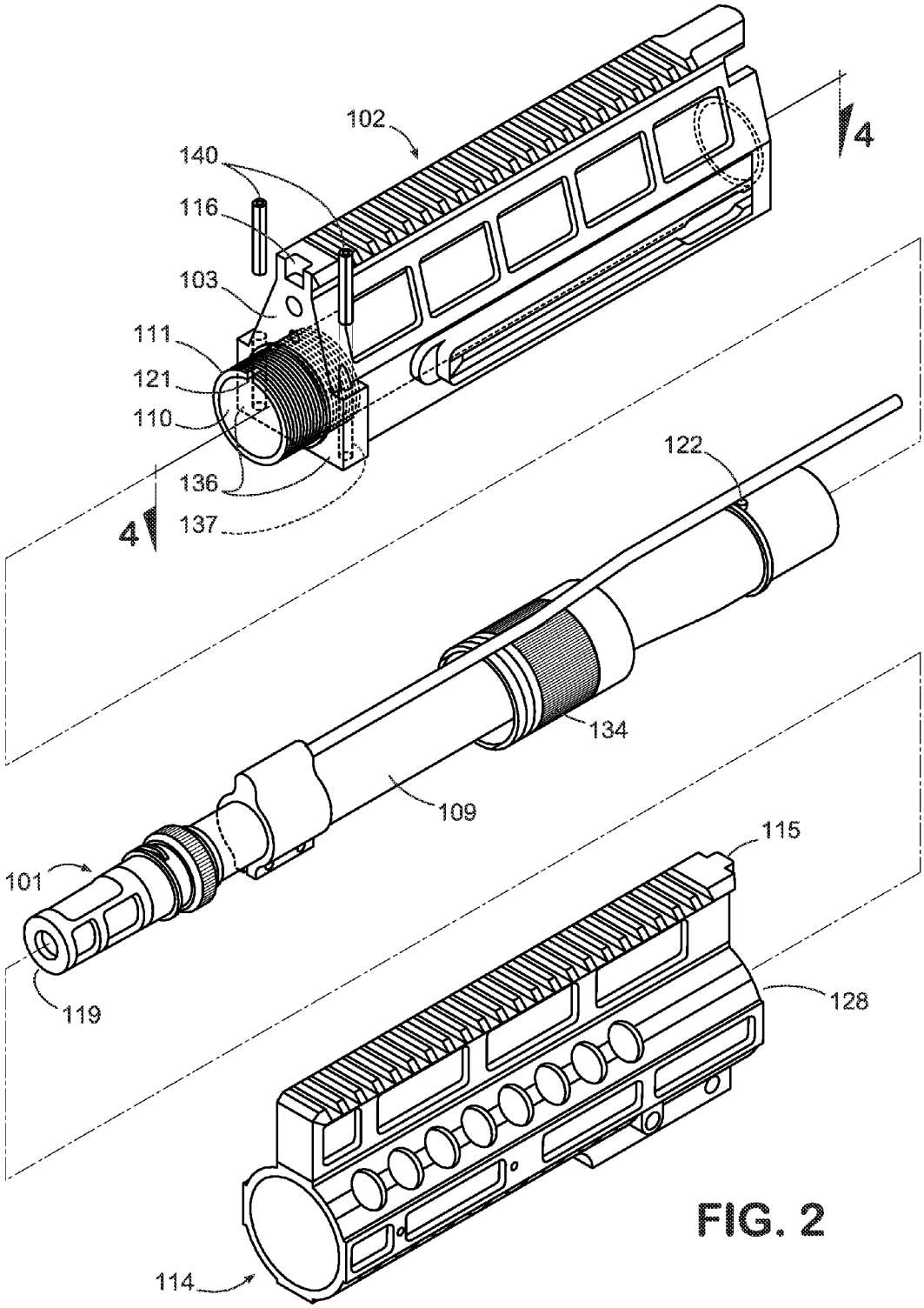
FIG. 2 is an exploded perspective view of the progression of the assembly of the liner insert within a first portion of the upper receiver assembly, attachment of the barrel assembly, and attachment of a second portion of the upper receiver assembly in accordance with one exemplary embodiment of the present invention, utilizing the components featured in FIG. 1.

With reference to FIG. 2, barrel assembly 101 is affixed to fore end 111 of liner insert 110 and front face 103 of aft portion 102 of upper receiver assembly by means of a threaded barrel nut connector sleeve 134. Barrel assembly 101 is aligned with the aft portion 102 of the upper receiver assembly, such that the rearward end 120 of the barrel 109 is aligned with threaded fore end 111 of liner insert 110. Aft end 102 of barrel assembly 101 is inserted inside fore end 111 of liner insert 110. In some applications, standard barrel assemblies may contain a barrel alignment pin 122 at the 12 o'clock position on along the outer diameter of aft segment of barrel 109, which pin can be accommodated in embodiments by a corresponding barrel alignment slot 121 at the 12 o'clock position on the front edge of fore end 111 of liner insert 110. Threaded barrel nut connector sleeve 134 is threaded onto threads 113 on the outside diameter of fore end 111 of liner insert 110 and tightened to secure barrel assembly 101 to aft portion 102 of upper receiver assembly.

With further reference to FIG. 2 aft portion 102 of upper receiver assembly and barrel assembly 101 are coupled to a fore portion 114 of upper receiver assembly, typically comprising a hand guard, to constitute the upper receiver assembly. In some embodiments, fore portion of upper receiver assembly 114 comprising hand guard is aligned with aft portion 102 of upper receiver assembly such that forward end 119 of barrel assembly 101 is fed through rearward portion 128 of fore (hand guard) portion 114 of upper receiver assembly. In some embodiments, aft portion 102 of upper receiver assembly and fore (hand guard) portion 114 of upper receiver assembly are joined by aligning an alignment tab 115 with alignment tab receptacle port 116 and inserting alignment tab 115 into alignment tab receiver compartment 116 to comprise the assembled upper receiver referenced in FIG. 3.

Figures 3, 4:
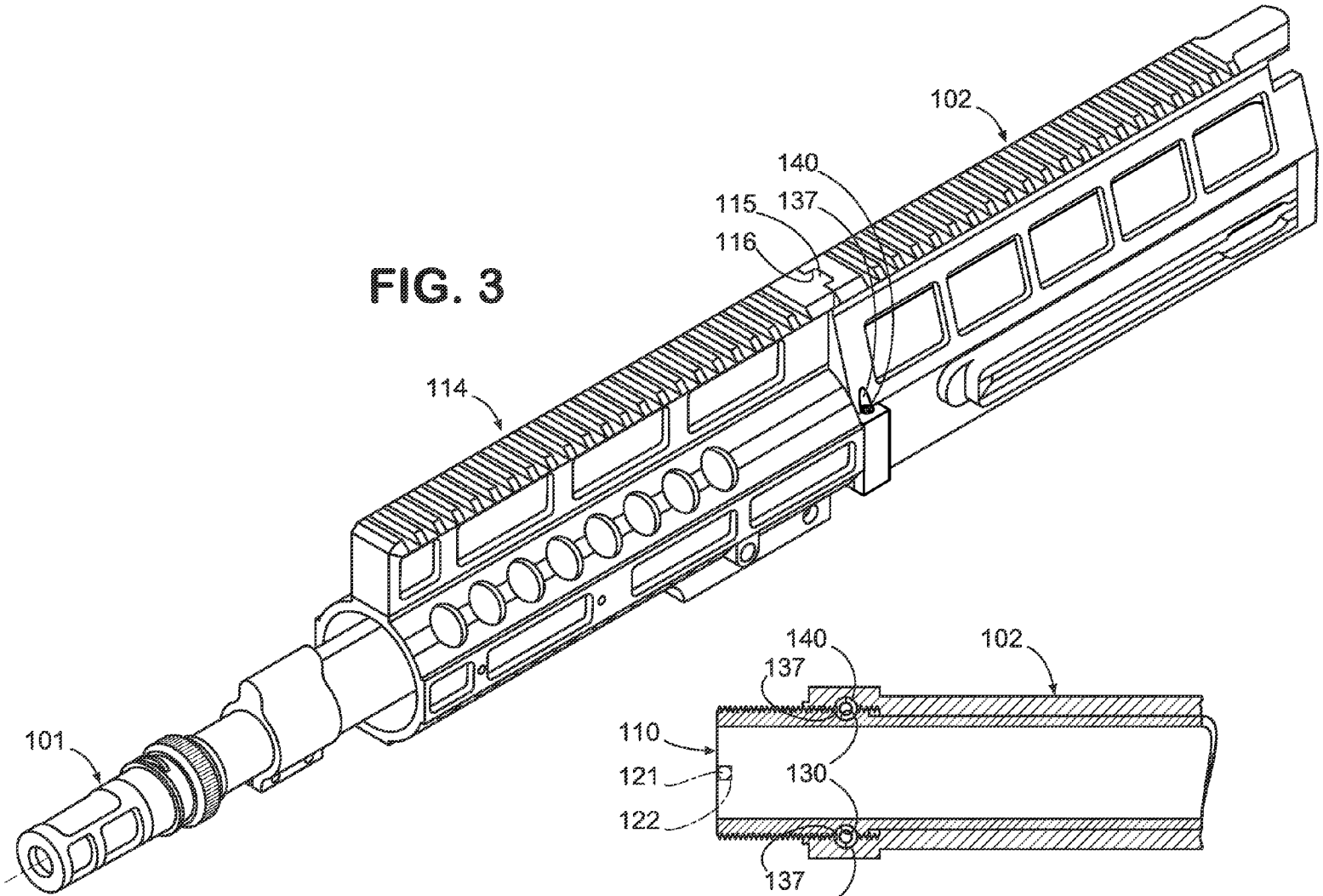
FIG. 3 is a perspective view showing the assembled attachment of the first and second portions of the upper receiver assembly to the barrel assembly as depicted in FIG. 2, in accordance with one exemplary embodiment of the present invention.
FIG. 4 is a perspective view of the securing of the liner insert within the first portion of the upper receiver assembly utilizing the screws or pins featured in FIG. 1 to secure the liner insert and prevent its rotation within the upper receiver assembly.

FIG. 3 is a perspective view of the joined of the barrel assembly 101, aft portion 102 of upper receiver assembly, and fore (hand guard) portion 114 of upper receiver assembly as depicted in FIGS. 1 and 2.

With reference to FIG. 4, liner insert 110 is secured within the aft portion 102 of upper receiver assembly utilizing the anchor pins 140 referenced in FIG. 1 to secure liner insert 110 and prevent its rotation within the upper receiver assembly.

Utilizing hardened metal liner insert 110 inside aft portion 102 of upper receiver provides a strengthened cylindrical chamber in which a steel bolt carrier system can operate without damaging or degrading upper receiver. This strengthening of the upper receiver extends both the life cycle of the upper receiver as well as the rifle system. Strengthening of the upper receiver with a hardened metal liner insert is especially useful for military and police applications of the rifle system, where automatic modes of operation generate higher temperatures due to the rapid rates of firing of the rifle system and cycling of the bolt carrier system.

In the embodiment illustrated in FIGS. 1-4, the modular rifle system is an M-16 or AR-15 style rifle. For the purposes of this disclosure, the term "M-16 style rifle" generally refers to the M-16 automatic rifle commonly associated with the U.S. military and disclosed in U.S. Pat. No. 2,951,424, issued to Eugene M. Stoner on Sep. 6, 1960 (incorporated herein by reference in its entirety). The M16 rifle is a gas-operated rifle having a bolt and bolt carrier. Typically, the M16 is configured to fire .223 caliber rounds or other comparable rounds, such as, by way of example, 5.56×45 mm NATO rounds. The term "M-16 style rifle" also refers to variants of the M-16, which includes rifles sharing a commonality of parts with the M-16 and rifles that are derived from the M-16. One example variant of the M-16 is the AR-15 rifle, which is the semiautomatic civilian version of the M-16. Other example variants of the M-16 include rifles identified by the following appellations: XM16, XM16E1, M16A1, M16A2, M16A2E1, M16A2E2, M16A2E3, M16A2E4, M16A3, M16A4, XM177, XM177E1, XM177E2, CAR-15, M4 Carbine, M4A1 Carbine, M4E2, M4 MWS, Mk 4 Mod 0, M231, M231 FPW, KH2002, S5.56, MSSR, NORCINCO, M311/CQ, M14, M14 SMUD, GUU-5/P, Diemaco C7, Diemaco C8, SDM-R, SAM-R, Mark 11 SWS, Mark 12 SPR, SEAL Recon Rifle, Mark 18 CQBR, Ares Shrike, La France M16K, M249, XM8, MK16, FN SCAR Colt Commando, Colt Models 601, 602, 603, 604, 645, 645E, 646, 655, 656, 723, 725, 733, 920, 921, 921 HB, 925 and 945. The M-16 style rifle also refers to the AR-10/SR-25 rifle system in, for example, 7.62 mm/.308 caliber, and M110 and HK416 type direct-gas-operated or piston-driven rifles in multiple calibers. Still other variants of the M-16 that are known now or are developed later are intended to be included within the scope of the term "M-16 style rifle," as understood by a person of skill in the art.

While particular embodiments of modular rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. A modular rifle system with a strengthened upper receiver comprising:

a lower receiver assembly;

an upper receiver assembly;

a barrel assembly; and an upper receiver liner insert;

the upper receiver liner insert inserted within a first portion of the upper receiver assembly and secured within the first portion of the upper receiver assembly by engaged screw threads and anchor pins, the barrel assembly attached to the liner insert;

a second portion of the upper receiver assembly attached to the first portion of the upper receiver assembly; and the upper and lower receiver assemblies coupled.

2. The modular rifle system of claim 1, wherein the upper receiver liner insert is secured within the first portion of the upper receiver by engagement of screw threads on the liner insert with the screw threads within the first portion of the upper receiver.

3. The modular rifle system of claim 2, wherein the upper receiver liner insert is further secured by anchor pins inserted into the first portion of the upper receiver and impinging the liner insert.

4. The modular rifle system of claim 1, wherein the upper receiver liner insert is fashioned from hardened metal.

5. The modular rifle system of claim 4, wherein the hardened metal is stainless steel.

6. The modular rifle system of claim 1, wherein the barrel assembly is attached to the liner insert by a barrel nut connector sleeve threaded onto the liner insert.

7. The modular rifle system of claim 1, wherein the second portion of the upper receiver assembly is coupled to the first portion of the upper receiver assembly by means of an alignment tab and an alignment tab receptacle.

8. The modular rifle system of claim 1, wherein the rifle system is an M-16 or AR-15 style rifle system.

9. A modular rifle system comprising:

a lower receiver assembly;

an upper receiver assembly having a first portion and a second portion; and a barrel assembly, consisting of a barrel and a barrel nut connector sleeve; and an upper receiver liner insert within the first portion of the upper receiver assembly;

the upper receiver liner insert secured within the first portion of the upper receiver assembly, the barrel assembly attached to the liner insert, a second portion of the upper receiver assembly attached to the first portion of the upper receiver assembly, and the upper and lower receiver assemblies coupled.

10. The modular rifle system of claim 9, wherein the upper receiver liner insert is secured within the first portion of the upper receiver by engagement of screw threads on the liner insert with the screw threads within the first portion of the upper receiver.

11. The modular rifle system of claim 10, wherein the upper receiver liner insert is further secured by anchor pins inserted into the first portion of the upper receiver and impinging the liner insert.

12. The modular rifle system of claim 9, wherein the upper receiver liner insert is fashioned from hardened metal.

13. The modular rifle system of claim 12, wherein the hardened metal is stainless steel.

14. The modular rifle system of claim 9, wherein the barrel assembly is attached to the liner insert by a barrel nut connector sleeve threaded onto the liner insert.

15. The modular rifle system of claim 9, wherein the second portion of the upper receiver assembly is coupled to the first portion of the upper receiver assembly by means of an alignment tab and an alignment tab receptacle.

16. The modular rifle system of claim 9, wherein the rifle system is an M-16 or AR-15 style rifle system.

17. A method of strengthening an upper receiver of a modular rifle system having an upper receiver assembly and a removable barrel assembly, comprising the steps of:

inserting a liner insert within a first portion of the upper receiver assembly securing the liner insert within the first portion of the upper receiver assembly by engaging screw threads on the liner insert with receiving threads within the first portion of the upper receiver assembly;

further securing the liner insert within the first portion of the upper receiver assembly by insertion of anchoring devices into the first portion of the upper receiver assembly;

attaching the barrel assembly to the liner insert; and attaching a second portion of the upper receiver assembly to the first portion of the upper receiver assembly.

18. The method of strengthening the upper receiver of the modular rifle system of claim 17, wherein the anchoring devices are anchor pins inserted into the first portion of the upper receiver and impinging into the liner insert.

19. The method of strengthening the upper receiver of the modular rifle system of claim 17, wherein the upper receiver liner insert is fashioned from stainless steel.

20. The method of strengthening the upper receiver of the modular rifle system of claim 17, wherein the barrel assembly is attached to the liner insert by a barrel nut connector sleeve threaded onto the liner insert.

* * * * *